US011229935B2

(12) United States Patent
Sohmshetty et al.

(10) Patent No.: US 11,229,935 B2
(45) Date of Patent: Jan. 25, 2022

(54) METHOD FOR MONITORING QUALITY OF HOT STAMPED COMPONENTS

(71) Applicant: FORD MOTOR COMPANY, Dearborn, MI (US)

(72) Inventors: Raj Sohmshetty, Canton, MI (US); Constantin Chiriac, Windsor (CA); Torsten Hallfeldt, Eschweiler (DE); Elizabeth Bullard, Royal Oak, MI (US); James Engle, Chesterfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1232 days.

(21) Appl. No.: 15/299,900

(22) Filed: Oct. 21, 2016

(65) Prior Publication Data

US 2018/0111179 A1 Apr. 26, 2018

(51) Int. Cl.

| | |
|---|---|
| ***B21D 37/16*** | (2006.01) |
| ***B21C 51/00*** | (2006.01) |
| ***C21D 1/673*** | (2006.01) |
| ***C21D 11/00*** | (2006.01) |
| ***B21D 22/02*** | (2006.01) |

(52) U.S. Cl.

CPC ..... *B21C 51/00* (2013.01); *B21D 22/022* (2013.01); *B21D 37/16* (2013.01); *C21D 1/673* (2013.01); *C21D 11/005* (2013.01)

(58) Field of Classification Search

CPC .... B21D 22/022; B21D 22/208; B21D 37/16; B21C 51/00; G01F 1/6888; G01F 1/86; C21D 1/673

See application file for complete search history.

(56) References Cited

U.S. PATENT DOCUMENTS

| | | | | |
|---|---|---|---|---|
| 4,474,044 | A | 10/1984 | Leistner et al. | |
| 6,742,374 | B2 * | 6/2004 | Ozawa | B21J 1/06 72/342.4 |
| 2009/0320547 | A1 * | 12/2009 | Horton | B21J 13/02 72/342.3 |
| 2011/0068519 | A1 * | 3/2011 | Kwon | B21D 37/16 266/87 |

(Continued)

FOREIGN PATENT DOCUMENTS

| | | | |
|---|---|---|---|
| CN | 102029310 | A | 4/2011 |
| CN | 102172719 | A | 9/2011 |

(Continued)

OTHER PUBLICATIONS

Translation; CN102172719, Sep. 2011.*

(Continued)

*Primary Examiner* — Edward T Tolan

(74) *Attorney, Agent, or Firm* — Vincent Mastrogiacomo; Brooks Kushman P.C.

(57) ABSTRACT

A hot stamping system includes a controller programmed to alter a coolant flow rate, without altering cycle time, in an active cooling system of a die arrangement, configured to hot stamp metal into components, based on an amount of heat transferred from the components to the active cooling system such that a grain structure of the components transitions from an austenitic state to a martensitic state while the die arrangement is closed.

16 Claims, 3 Drawing Sheets

(56) References Cited

U.S. PATENT DOCUMENTS

| | | | | |
|---|---|---|---|---|
| 2013/0125603 | A1* | 5/2013 | Liu | B21D 37/16 72/342.3 |
| 2013/0305802 | A1 | 11/2013 | Lee et al. | |
| 2015/0075246 | A1* | 3/2015 | Dorr | B21D 22/201 72/347 |
| 2015/0251246 | A1* | 9/2015 | Reikher | B22D 17/2218 164/113 |
| 2016/0326608 | A1* | 11/2016 | Hayashi | C22C 38/001 |

FOREIGN PATENT DOCUMENTS

| | | | |
|---|---|---|---|
| CN | 103981349 | A | 8/2014 |
| CN | 204052647 | U | 12/2014 |
| CN | 104294020 | A | 1/2015 |
| CN | 104942109 | A | 9/2015 |
| JP | S58177414 | A | 10/1983 |

OTHER PUBLICATIONS

Chinese Office Action dated Aug. 5, 2019 for CN Appln. No. 201710090632.5.

M. Naderi et al., "The Effects of Non-Isothermal Deformation on Martensitic Transformation in 22MnB5 steel", Elsevier, Materials Science and Engineering A 487 (2008) pp. 445-455.

Chinese 1st Office Action, CN 201710974415.7, dated May 13, 2020 and English Translation. 15 pages.

* cited by examiner

METHOD FOR MONITORING QUALITY OF HOT STAMPED COMPONENTS

TECHNICAL FIELD

The disclosure relates to a hot stamping system, and a method for monitoring the quality of components formed in the hot stamping system as well as optimization of the hot stamping system cycle time.

BACKGROUND

The requirements for high security, low weight, and good fuel economy have become increasingly important in automotive manufacturing. To meet all of these requirements, high strength steels have become increasingly popular in vehicle body manufacturing to improve crash behavior and at the same time lower the weight of the vehicle. The high strength steels may be produced at room temperature by cold stamping or at high temperatures at which the material is austenized. The latter process called hot stamping is a nonisothermal forming process for sheet metal, where forming and quenching take place in the same forming step. In comparison to components manufactured by the cold stamping process, hot stamping is capable of providing components having minimum springback, reduced sheet thickness, and superior mechanical properties such as high strength. Yet, hot stamping is a rather complicated process with a variety of process variables. Thus, ensuring that a hot stamping line efficiently produces components of constant quality remains a challenge. Determining whether the formed components achieved the desired metallurgical transformation remains difficult as traditional measuring techniques do not provide accurate information in real time. Yet without this determination, a manufacturer cannot efficiently ensure that the formed components possess the required mechanical properties.

SUMMARY

In at least one embodiment, a hot stamping system is disclosed. The system includes a controller programmed to alter a coolant flow rate, without altering cycle time, in an active cooling system of a die arrangement, configured to hot stamp metal into components. The alteration is based on an amount of heat transferred from the components to the active cooling system such that a grain structure of the components transitions from an austenitic state to a martensitic state while the die arrangement is closed. Altering the flow rate may include decreasing the flow rate in response to the amount exceeding a threshold amount. Altering the flow rate may include increasing the flow rate in response to the amount being less than a threshold amount. Altering the flow rate may include adjusting the flow rate in a main inlet, side channels, or both of the active cooling system. Altering the flow rate may include changing a chemical composition of the coolant. The amount may be based on a temperature or change in temperature of the die arrangement. The amount may be based on a temperature or change in temperature of the components.

In another embodiment, another hot stamping system is disclosed. The system may include a controller programmed to alter a coolant inlet temperature, without altering cycle time, in an active cooling system of a die arrangement, configured to hot stamp metal into components. The altering is based on an amount of heat transferred from the components to the active cooling system such that a grain structure of the components transitions from an austenitic state to a martensitic state while the die arrangement is closed. Altering the coolant inlet temperature may include decreasing the temperature in response to the amount exceeding a threshold amount. Altering the coolant inlet temperature may include increasing the temperature in response to the amount being less than a threshold amount. Altering the coolant inlet temperature may include increasing the temperature in response to the amount being less than a threshold amount. Altering the coolant inlet temperature may include altering chemical composition of the coolant. The amount may be based on a temperature or change in temperature of the die arrangement. The amount may be based on a temperature or change in temperature of the component.

In yet another embodiment, a monitoring method for hot stamped components is disclosed. The method may include altering by a controller a coolant flow rate or coolant inlet temperature, without altering cycle time, in an active cooling system of a die arrangement, configured to hot stamp metal into hot stamped components. The altering may be in response to an amount of heat transferred from the hot stamped components to the active cooling system being indicative of an austenitic to martensitic microstructure transformation while the die arrangement is closed. The altering may include decreasing the flow rate or coolant inlet temperature. The altering may include increasing the flow rate or coolant inlet temperature. The altering may include adjusting the flow rate in a main inlet, side channels, or both of the active cooling system. The altering may include changing a chemical composition of the coolant. The amount may be based on a temperature or change in temperature of the die arrangement. The amount may be based on a temperature or change in temperature of the hot stamped components.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Except where expressly indicated, all numerical quantities in this description indicating dimensions or material properties are to be understood as modified by the word "about" in describing the broadest scope of the present disclosure.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Figure 1:
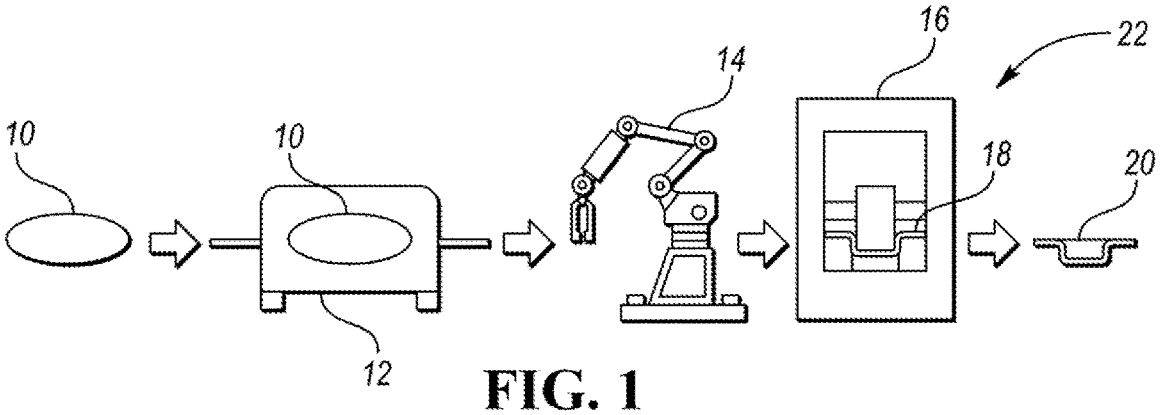
FIG. 1 depicts an exemplary schematic view of a hot stamping system in accordance with one or more embodiments.

Hot stamping, also called hot forming or press hardening, is a process of forming metal while the metal is very hot, usually in excess of 900° C., and subsequently quenching the formed metal in the closed die. Hot stamping may be direct or indirect. The hot stamping process converts low-tensile-strength metal to a very high-strength metal of about 150 to 230 kilo pounds per square inch (KSI). During a typical hot stamping process, schematically depicted in FIG. 1, a press-hardenable material such as boron steel blank 10 is heated to about 900 to 950° C. to an austenite state in the first stage of the press line or hot stamping system 22. The first stage lasts for about 4 to 10 minutes inside of a continuous-feed furnace 12. A robot transfer system 14 subsequently transfers the austenized blank 10 to a press 16 having a die arrangement 18. The transfer usually takes less than 3 s. A part 20 is formed in the die arrangement 18 from the blank 10 while the material is very hot. The blanks 10 are stamped and cooled down under pressure for a specific amount of time according to the sheet thickness after drawing depth is reached. During this period, the formed part 20, further also referred to as a component 20, is quickly cooled or quenched by being held in a closed die cavity having a water cooling system. Quenching is provided at a cooling speed of 50 to 100° C./s for a few seconds at the bottom of the stroke, which is when the material's grain structure is converted from the austenitic state to a martensitic state. Finally, the component 20 leaves the hot-stamping line at about 150° C. The component 20 has relatively high mechanical properties: tensile strength of about 1,400 to 1,600 MPa (200 to 230 KSI) and a yield strength of about 1,000 and 1,200 MPa (145 to 175 KSI).

The hot stamping process provides numerous advantages over other high-strength steel and advanced high-strength steel forming methods such as cold stamping. One of the advantages is providing stress-relieving capability which resolves problems such as springback and warping typically associated with other high-strength steel forming methods. Additionally, hot stamping allows the forming of complex parts in a single-step die and in only one stroke. Thus, multi-component assemblies can be redesigned and formed as one component, eliminating downstream joining processes such as welding and eliminating the need for additional parts. This may, in turn, reduce overall mass of the formed parts.

Hot stamped parts 20 have found broad application in automotive industry. Typically, hot stamping is best-suited to form components which are required to be both lightweight and strong at the same time. Exemplary automotive components formed by hot stamping include body pillars, rockers, roof rails, bumpers, door intrusion beams, carrier understructure, mounting plates, front tunnels, front and rear bumpers, reinforcement members, side rails, and other auto parts that are required to be strong enough to withstand a large load with minimal intrusion into the passenger compartment during a rollover and impact. The method thus enables producing such components meeting structural performance requirements while adding as little weight to a vehicle as possible.

The hot stamping process is quite complex and thus many process variables exist, thereby creating a need for a robust quality control system. Traditionally, the hot stamping process real time quality monitoring is done by measuring the component temperatures at the beginning and end of the hot stamping cycle. The temperature measurements are typically done using a pyrometer or an infrared camera. Such method; however, has several disadvantages. For example, the infrared camera temperature measurements are relatively inaccurate. Pyrometer, on the one hand, is capable of providing measurements of only one particular location on the component. The temperature in the location could be significantly different than the temperature in other locations on the component. Additionally, the component surface temperature could be different from the component interior temperature, especially in thicker components. An alternative approach for component quality control is a destructive testing. But this approach is time consuming and expensive and hence is done only on a few components.

Thus, obtaining component temperature measurements during the stamping process presents a difficulty. Yet, this information is critical for determination of whether the component has achieved desired temperature and, in turn, the required mechanical properties. It would be useful to determine whether the component has achieved the threshold temperature while the component remains in the die because the components cannot achieve the required cooling rates necessary to complete the transformation once the die is opened and the components are exposed to ambient temperatures. Thus, it would be desirable to know whether and when the components reached the threshold temperature as well as other parameters such as how quickly the components cool, how much the components have cooled, or the like. Having this information would help ensure that components with consistent mechanical properties are being produced. It would be further desirable to have an ability to control and adjust the active cooling system while the component is placed within the die.

Figure 2:
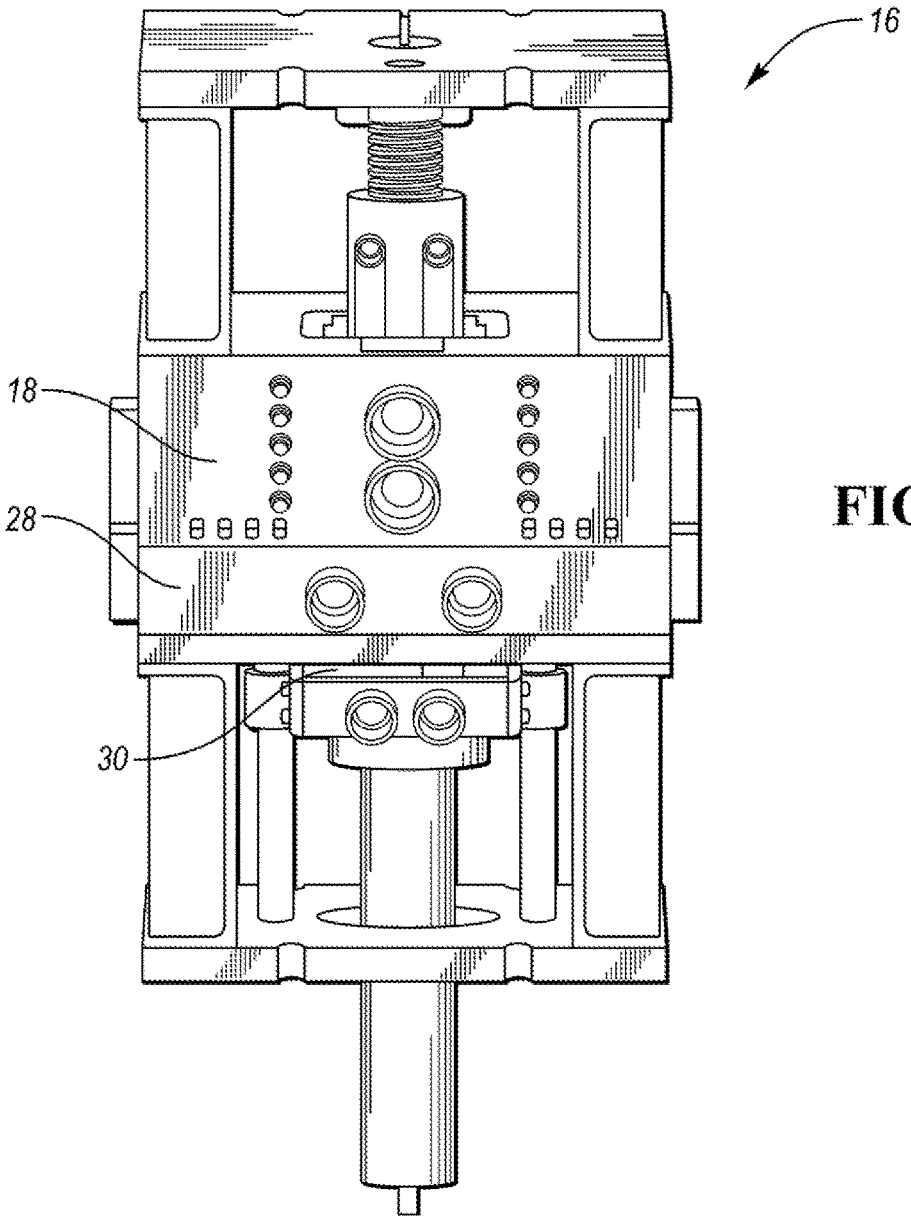
FIG. 2 depicts a schematic perspective side view of an exemplary hot stamping press incorporated in the hot stamping system depicted in FIG. 1.
Figure 3:
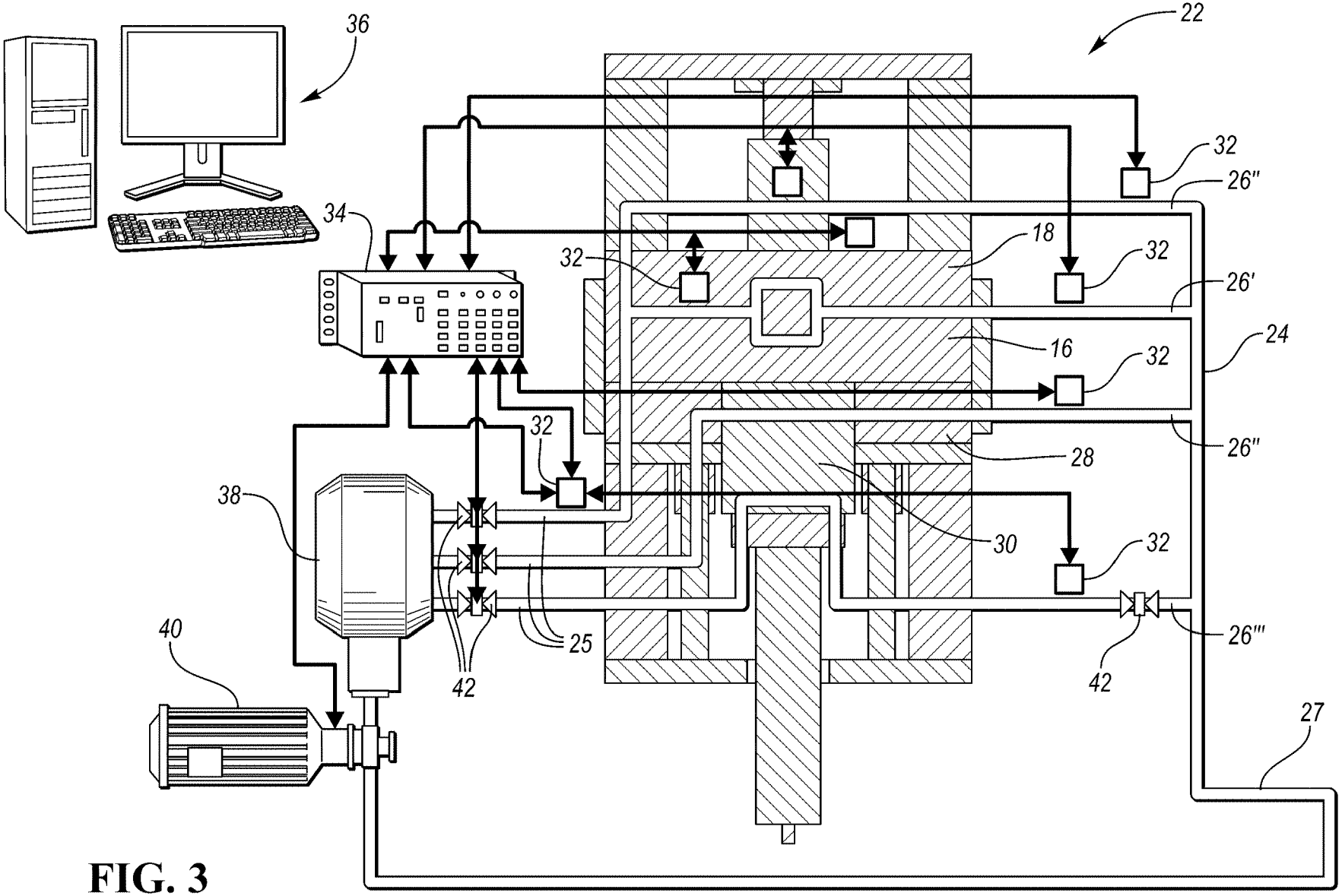
FIG. 3 depicts a schematic side view of a hot stamping system according to one or more embodiments including a cross-sectional view of the hot stamping press depicted in FIG. 2.

According to one or more embodiments, a hot stamping system 22, such as one depicted in FIGS. 2 and 3, is provided for monitoring the amount of heat extracted from each component 20 during the hot stamping process, which was described above. The hot stamping system 22 is useful for both direct and indirect hot stamping. The data then serves for determining whether the required metallurgical transformation has occurred in the component 20 and altering the coolant flow rate, the coolant temperature at the inlet 25 of the cooling system 24, or both in response to this data, if an adjustment is needed.

The hot stamping system 22 includes a hot stamping press 16. The hot stamping press 16 may be a conventional deep drawing press, a hydraulic or servo press including conventional parts such as the die arrangement 18, a blank holder 28, a punch 30, and the like, depicted in FIG. 2. The press 16 is capable of maintaining tonnage at the bottom of the stroke while the component 20 is being quenched. As can be seen in FIG. 3, the hot stamping system 22 further includes a cooling system 24 providing the quenching. The cooling system 24 may include at least one inlet 25 and at least one outlet 27. The inlet 25 and/or outlet 27 may include multiple cooling channels 26 which may be monitored. To provide an effective cooling system 24, several portions of the press 16 may have to be actively cooled. The portions may include the punch 30, the blank holder 28, and/or the die 18.

In one or more embodiments, the cooling system 24 may include a number of cooling channels 26, incorporated within one or more portions of the system 22 described above, in which the cooling fluid, also called a coolant, is circulating. Any economically feasible coolant such as water may be used as the cooling fluid within the cooling system 24. The coolant may be supplied from a fluid storage tank 38 with a pump 40 through one or more valves 42. The valves 42 may be controlled by one or more controllers 34. To reach the desirable tensile strength of up to 1600 MPa of the components 20, a complete transformation of the austenitic to martensitic microstructure of the components 20 is required. Therefore, cooling rates faster than 27° C./s in the component must be achieved to avoid bainitic or even ferritic-pearlitic transformation. The cooling channels 26 thus provide rapid cooling at a cooling rate of >27° C./s or about 50 to 100° C./s to the part which results in the components' phase transformation from austenite to martensite at a temperature interval of about 420 to 280° C.

As can be further seen in FIG. 3, the hot stamping system 22 may include sensors 32 monitoring a number of variables such as ambient temperature, die temperature at key measurement locations, cooling system inlet 25 and/or outlet 27 flow rate and/or temperature, incoming and/or outgoing component 20 temperature and/or temperature distribution, the like, or a combination thereof. The sensors 32 may be electronic sensors. The sensors 32 may include single point sensors such as a pyrometer or a sensor monitoring a temperature spectrum such as an infrared camera. Alternatively, the sensors 32 may be thermocouples or other contact sensors. The sensors 32 may be installed at measurement locations on various portions of the hot stamping system 22. For example, a pyrometer may be installed so that a temperature of the blank 10 being loaded into the furnace 12 is monitored. In one or more embodiments, one or more thermocouples may be installed within the die arrangement 18 next to the cooling system 24 so that the thermocouples may monitor the inlet 25 and/or outlet 27 temperatures. The sensors 32 may continuously send input signals to the one or more controllers 34. Alternatively, the sensors 32 may send input signals at random or predetermined intervals.

The one or more controllers 34 are programmed to alter the coolant flow rate and/or coolant inlet 25 temperature based on an amount of heat transferred from the components 20 to the active cooling system 24. The coolant inlet 25 temperature may refer to the temperature of the channel inlet 25 or to the temperature of the coolant as it enters the inlet 25. The coolant flow rate is being altered while the cycle time is kept at a constant value. The one or more controllers 34 have one or more processing components such as one or more microprocessor units (not depicted) which enable the controllers 34 to process input data. The input data may be supplied from the sensors 32 and/or a computer system 36 connected to the controllers 34. The input data supplied by the computer system 36 may include component 20 details including component 20 material specification, weight, geometry, and/or thickness. The input data may further include material properties such as the coolant heat capacity, latent heat for phase transformation, and/or phase transformation diagrams. Additional input data may include thermal processing curves for the component 20. This data may be supplied to the controller 34 prior to the hot stamping process, during the process, or both.

The input data supplied from the sensors 32 may include real time die arrangement 18/cooling system 24 inlet and outlet flow rates and temperatures, real time die arrangement 18 temperature at predetermined measurement locations, temperature and temperature distribution of the incoming and outgoing component, or a combination thereof. At set intervals, the one or more controllers 34 compare the signal to a predefined set point. If the input signal deviates from the set point, the controllers 34 provide a corrective output signal to one or more portions of the cooling system 24. The one or more portions are responsible for altering the flow rate. For example, the portions may be one or more valves 42 being adjusted to allow a higher or lower volume of the coolant to flow through the cooling system 24.

In at least one embodiment, more than one controller 34 is utilized in the hot stamping system 22. For example, a separate controller 34 may be provided for the hot stamping press 16 and a separate controller 34 may be provided for the cooling system 24. In another embodiment, the inlet 25 and outlet 27 flow data, and/or the coolant inlet 25 temperature may be collected by controllers 34 independent from the die arrangement controller 34. The one or more controllers 34 may be in communication with one another and/or with other portions of the hot stamping system 22.

Based on the component and material property input data, the controller 34 determines the threshold amount of heat, also called heat extraction target $Q_T$, which is required to be extracted from the die arrangement 18. Based on the real time monitoring input data, the controller 34 calculates the heat extracted from each component 20, also called extracted heat $Q_E$, in real time. Once the steady state of the die arrangement 18 is reached, the controller 34 may effectively determine if the required metallurgical transformation has occurred in the component 20 and thereby whether the required mechanical properties of the component 20 have been achieved. While temperature in the die arrangement 18 does not change once the steady state is reached, changes in ambient temperature may occur. Accommodation may be thus made for changes in ambient temperature once the die arrangement 18 has reached steady state by monitoring the ambient temperature and adjusting calculations. The one or more controllers 34 may process the input data and calculate the threshold amount of heat in every cycle, every other cycle, every third cycle, a random cycle, or the like. To achieve optimal efficiency of the hot stamping system 22, it is desirable that the component 20 is removed from the die arrangement 18 as soon as the controllers 34 determine that the threshold amount of heat has been extracted from the component 20. This allows for component quality monitoring.

The one or more controllers 34 may dynamically alter the coolant flow rate, the coolant inlet 25 temperature of the cooling system 24, or both, based on the indication of the amount of heat transferred from the component 20 to the cooling system 24, on a temperature or change in temperature of the die arrangement 18, or on a temperature or change in temperature of the components 20, while the cycle time is set at a constant value. The one or more controllers 34 may alter the coolant flow rate by decreasing the flow rate in response to the amount exceeding a threshold amount, thus lowering the amount of coolant flowing through the cooling system 24 in a time interval. Alternatively, the controllers 34 may alter the coolant flow rate by increasing the flow, thus raising the volume of coolant flowing through the cooling system 24 in a given time period. The increase and/or decrease of the coolant flow may be performed by adjusting one or more valves 42. The valves 42 may be any flow control valves capable of maintaining a variable flow rate through the valve. The valves 42 may allow one-way flow. The valves 42 may be two-way, or three-way valves. Non-limiting example valves 42 may include a globe valve, a butterfly valve, a needle valve, or the like.

Alternatively, or in addition to adjusting the coolant flow rate, the controllers 34 may dynamically alter the coolant inlet 25 temperature by decreasing the temperature in response to the amount exceeding a threshold amount. Alternatively, the adjustment may include increasing the temperature in response to the amount being less than a threshold amount. The cooling system may include a heating and/or cooling device capable of adjusting the temperature of the coolant within the cooling system 24. The one or more controllers 34 may be programmed to control the heating and/or cooling device. The heating and/or cooling device may be located downstream from an inlet 25 of the one or more channels of the cooling system 24.

The adjustment of the flow rate and/or coolant inlet temperature may be limited to one channel of the cooling system 24. Alternatively, more than one channel may be adjusted. The flow rate and/or coolant inlet temperature may be thus altered in the main inlet channel 26', in one or more side channels 26", or both. Alternatively, additional channels 26''' may be activated by one or more controllers 34 in response to input data such that a channel 26''' which was isolated from the cooling system 24 comes in fluid communication with the cooling system 24. All of the channels 26 may be adjusted in the same manner and/or at the same time. Alternatively, each channel 26 may be adjusted separately or in a different manner than at least one other channel 26. Additionally, one or more of the inlet channels 26 may include a mechanism increasing or decreasing the coolant speed or flow, altering the type of flow from turbulent to laminar or vice versa, or both. An example mechanism may be a venturi.

The flow rate and/or coolant inlet temperature in different channels may be adjusted at the same or different times. The controllers 34 may receive additional input data to adjust the coolant flow rate and/or coolant inlet temperature. The additional input data may include individual channel dimensions, channel geometry, coolant fluid dynamics values, the location of the channel within the die arrangement 18, the type of coolant present in the channel, chemical composition of the coolant, thermodynamic values of the cooling system 24, or the like. The additional data may be supplied to the controllers 34 prior to start of the hot stamping process, during the process, or both.

Adjusting the flow rate and/or coolant inlet temperature may include changing chemical composition of the coolant. The coolant's chemistry may be adjusted to achieve faster or slower coolant flow or increase or decrease the coolant inlet temperature in the cooling system 24 at the same coolant volume. For example, the adjustment can be achieved by mixing the coolant with a composition having a lower or higher density. The composition to be mixed with the coolant depends on the type of coolant present in the cooling system 24 and its properties. The coolant may be partially or entirely replaced by a different coolant having a different density. In such embodiments, the cooling system 24 may include one or more additional storage tanks containing the substance to be mixed with the coolant of the coolant system 24. The additional storage tank(s) may include a fluid or a solid substance such as a salt or a salt mixture.

The hot stamping system 22 may include further components such as a furnace 12, upstream of the press, the furnace being capable of heating the blank 10 to a temperature above about 900° C. Since the heated blank 10 is very hot, at least one automated part handling system such as a shuttle or a robot transfer system 14 is provided for transferring the heated blank 10 from the furnace 12 to the hot stamping press 16, from the press 16 into an exit bin, or both. The hot stamping system 22 may additionally include additional stations such as a cleaning unit, trimming unit, a unit for the component 20 cutting, the like, or a combination thereof.

In one or more embodiments, a method is provided for quality monitoring of hot stamped components. The method is applicable to both direct and indirect hot stamping. The method may include determining whether desired mechanical properties of the components 20 have been achieved by determining whether a threshold amount of heat to be extracted from the components 20 has been extracted. The method may further include altering, by a controller 34, a coolant flow rate and/or coolant inlet temperature of a die arrangement 18, configured to stamp blanks 10 into the hot stamped components 20 and having an active cooling system 24, in response to an indication of an amount of heat transferred from the hot stamped components 20 to the cooling system 24.

The step of forming a blank 10 into a hot stamped component 20 in the hot stamping system 22 was described above. The heated blank 10 may be inserted into a stamping die arrangement 18 having a cooling system 24 for a time period. The formed component 20 may be quenched by being held in the closed die arrangement 18 for a period of time.

The method may include entering and/or updating input data relating to the cooling fluid of the cooling system 24, to the hot stamping system 22, to the blank 10, to the component 20, or a combination thereof into a computer system 36. The input data may be supplied to the one or more controllers 34. The input data may be then processed, the heat energy to be extracted from the components 20 may be calculated, and based on the calculated threshold amount, the flow rate and/or coolant inlet temperature may be optimized while the cycle time is being kept constant.

A step of installing one or more electronic sensors 32 at predetermined locations within the hot stamping system 22 for monitoring process variables and providing input data to one or more controllers 34 may be included. The locations for the one or more sensors 32 may be selected based on the required data to be supplied to the controllers 34. The locations such as the inlet and outlet channel or channels 26, the die arrangement 18, or other portions of the hot stamping system 22 may be monitored continuously or discontinuously. The temperature and/or flow rate of the inlet and/or outlet flow channel or channels 26 may be monitored. Additionally, the temperature and/or temperature of incoming and/or outgoing components 20 may be monitored. The cycle time may be monitored. The stamping die arrangement 18 temperature may be monitored at one or more measurement locations. The data from the sensors 32 may be continuously supplied to the controllers 34. The input signals from the sensors 32 may be received by the controllers 34. The controllers 34 may send output signals to one or more portions of the hot stamping system 22.

The method may include checking if the temperature in the die arrangement 18 is stabilized. Upon reaching steady state, the flow rate and/or the coolant inlet temperature of the die arrangement 18 may be altered. The altering may include decreasing or increasing the cycle time in response to the amount exceeding a threshold amount. The altering may include adjusting the chemical composition of the coolant. The altering will result in meeting the threshold amount of heat to be extracted from the components 20. The operation of the die arrangement 18, the hot stamping system 22, or both may be restarted after optimization of the coolant flow rate, coolant inlet temperature, or both. The altering may include activating or deactivating various cooling channels 26.

Figure 4:
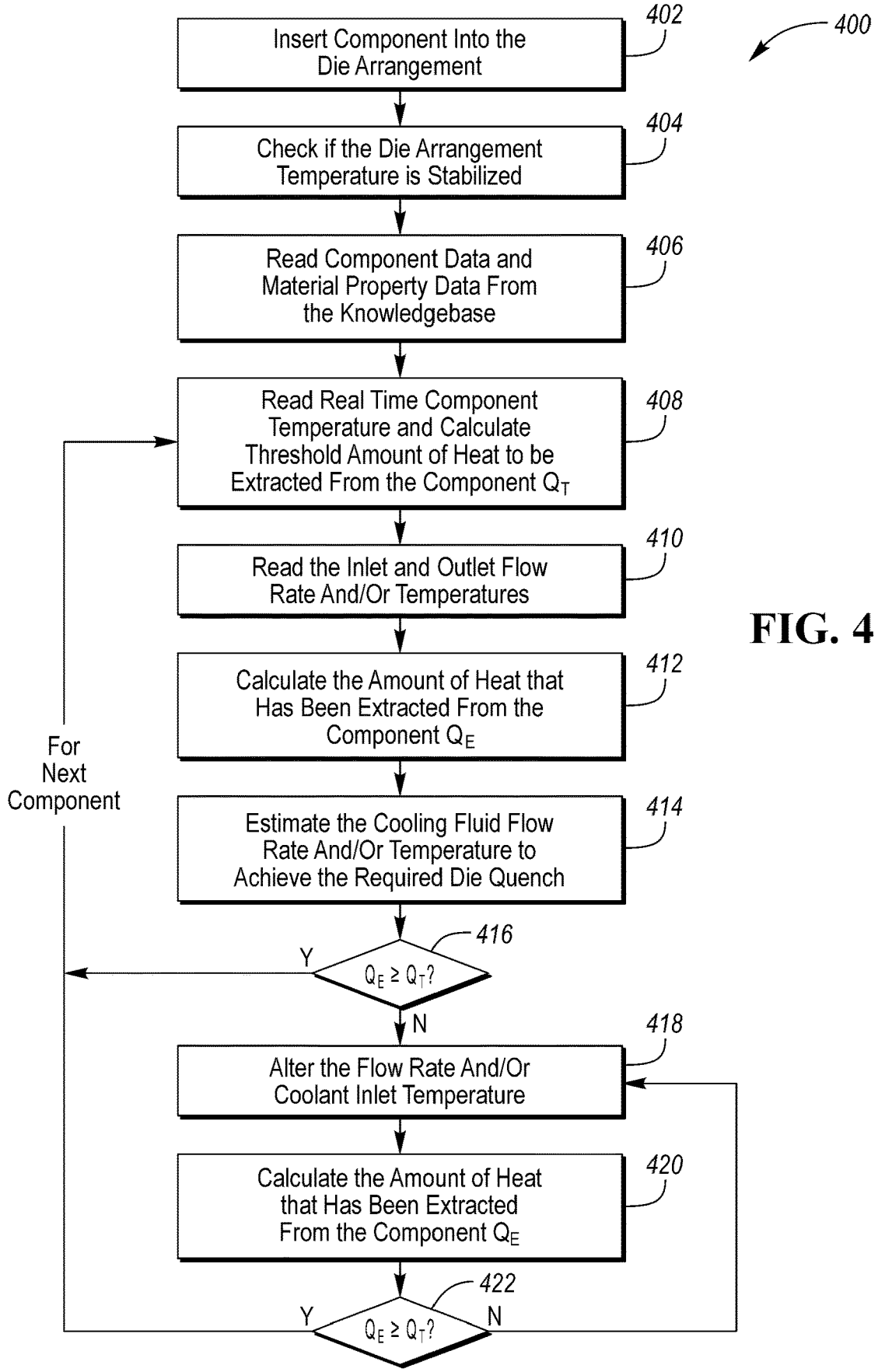
FIG. 4 schematically shows a series of steps for quality monitoring of hot stamped components and cooling system optimization of the hot stamping system according to one or more embodiments.

FIG. 4 illustrates an example method for quality monitoring of hot stamped components 400. The method may begin at block 402, where the controller 34 controls insertion of the blank/component into the die arrangement 18. In one example, the controller 34 transmits a command to one or more subsystems of the hot stamping system 22 to insert the component into the die arrangement 18. The controller 34 checks if the die arrangement temperature is stabilized at block 404 such as by receiving a signal from the sensors 32. The controller 34 then reads the component data and material property data from the knowledgebase at block 406. At block 408, the controller 34 reads real time component temperature, for example by receiving input signals from one or more sensors, and calculates the threshold amount of heat $Q_T$ to be extracted from the component. Further, at block 410, the controller 34 reads the inlet and outlet flow rate and/or temperatures. At block 412, the controller 34 calculates the amount of heat that has been extracted from the component $Q_E$. Additionally, at block 414, the controller 34 may estimate the cooling fluid flow rate and/or temperature to achieve the required die quench. The method may continue at block 416, where the controller 34 assesses whether $Q_E \geq Q_T$. If the answer to $Q_E \geq Q_T$ at block 416 is "yes," the controller 34 calculates the threshold amount of heat to be extracted from the component $Q_T$ for the next component. If the answer to $Q_E \geq Q_T$ at block 416 is "no," the controller 34 alters the flow rate and/or coolant inlet temperature at block 418. At block 420, the controller 34 may again calculate the amount of heat that has been extracted from the component $Q_E$. The controlled 34 may again assess whether $Q_E \geq Q_T$ at block 422. If the answer to $Q_E \geq Q_T$ at block 422 is "yes," the controller 34 may calculate the threshold amount of heat to be extracted from the component $Q_T$ for the next component. If the answer to $Q_E \geq Q_T$ at block 422 is "no," the controller 34 may again alter the flow rate and/or coolant inlet temperature.

The processes, methods, or algorithms disclosed herein may be deliverable to or implemented by a processing device, controller, or computer, which may include any existing programmable electronic control unit or dedicated electronic control unit. Similarly, the processes, methods, or algorithms may be stored as data and instructions executable by a controller or computer in many forms including, but not limited to, information permanently stored on non-writeable storage media such as ROM devices and information alterably stored on writeable storage media such as floppy disks, magnetic tapes, CDs, RAM devices, and other magnetic and optical media. The processes, methods, or algorithms may also be implemented in a software executable object. Alternatively, the processes, methods, or algorithms may be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A hot stamping system comprising:

a controller programmed to alter a coolant flow rate, without altering cycle time, in an active cooling system of a die arrangement, configured to hot stamp metal into components, based on an amount of heat transferred from the components to the active cooling system such that a grain structure of the components transitions from an austenitic state to a martensitic state while the die arrangement is closed, wherein altering the flow rate includes adjusting the flow rate in a main inlet, side channels, or both of the active cooling system.

2. The system of claim 1, wherein altering the flow rate further includes decreasing the flow rate in response to the amount exceeding a threshold amount.

3. The system of claim 1, wherein altering the flow rate further includes increasing the flow rate in response to the amount being less than a threshold amount.

4. The system of claim 1, wherein altering the flow rate further includes changing a chemical composition of the coolant.

5. The system of claim 1, wherein the amount is based on a temperature or change in temperature of the die arrangement.

6. The system of claim 1, wherein the amount is based on a temperature or change in temperature of the components.

7. A hot stamping system comprising:

a controller programmed to alter a coolant inlet temperature, without altering cycle time, in an active cooling system of a die arrangement, configured to hot stamp metal into components, based on an amount of heat transferred from the components to the active cooling system such that a grain structure of the components transitions from an austenitic state to a martensitic state while the die arrangement is closed, wherein altering the coolant inlet temperature includes increasing, decreasing, or both the temperature in response to the amount exceeding a threshold amount.

8. The system of claim 7, wherein altering the coolant inlet temperature further includes altering chemical composition of the coolant.

9. The system of claim 7, wherein the amount is based on a temperature or change in temperature of the die arrangement.

10. The system of claim 7, wherein the amount is based on a temperature or change in temperature of the component.

11. A monitoring method for hot stamped components, comprising:

altering by a controller a coolant flow rate or coolant inlet temperature, without altering cycle time, in an active cooling system of a die arrangement, configured to hot stamp metal into hot stamped components, in response to an amount of heat transferred from the hot stamped components to the active cooling system being indicative of an austenitic to martensitic microstructure transformation while the die arrangement is closed, wherein the altering includes adjusting the flow rate in a main inlet, side channels, or both of the active cooling system.

12. The method of claim 11, wherein the altering further includes decreasing the flow rate or coolant inlet temperature.

13. The method of claim 11, wherein the altering further includes increasing the flow rate or coolant inlet temperature.

14. The method of claim 11, wherein the altering further includes changing a chemical composition of the coolant.

15. The method of claim 11, wherein the amount is based on a temperature or change in temperature of the die arrangement.

16. The system of claim 11, wherein the amount is based on a temperature or change in temperature of the hot stamped components.

* * * * *